US010981031B1

(12) United States Patent
Guo

(10) Patent No.: US 10,981,031 B1
(45) Date of Patent: Apr. 20, 2021

(54) MULTIFUNCTIONAL ABDOMINAL EXERCISE WHEEL WITH PULLING ROPE

(71) Applicant: Zejiao Guo, Guangzhou (CN)

(72) Inventor: Zejiao Guo, Guangzhou (CN)

( * ) Notice: Subject to any disclaimer, the term of this patent is extended or adjusted under 35 U.S.C. 154(b) by 0 days.

(21) Appl. No.: 17/036,436

(22) Filed: Sep. 29, 2020

(30) Foreign Application Priority Data

Sep. 22, 2020 (CN) ..... 202011004644.X

(51) Int. Cl.

| | |
|---|---|
| ***A63B 21/22*** | (2006.01) |
| ***A63B 21/00*** | (2006.01) |
| ***A63B 21/04*** | (2006.01) |
| ***A63B 71/04*** | (2006.01) |
| ***A63B 23/035*** | (2006.01) |
| ***A63B 21/045*** | (2006.01) |
| ***A63B 21/055*** | (2006.01) |
| ***A63B 22/20*** | (2006.01) |
| ***A63B 23/02*** | (2006.01) |

(Continued)

(52) U.S. Cl.

CPC ..... *A63B 21/22* (2013.01); *A63B 21/0421* (2013.01); *A63B 21/0455* (2013.01); *A63B 21/0552* (2013.01); *A63B 21/153* (2013.01); *A63B 22/20* (2013.01); *A63B 23/0205* (2013.01); *A63B 23/0211* (2013.01); *A63B 23/03541* (2013.01); *A63B 71/04* (2013.01); *A63B 22/201* (2013.01); *A63B 22/205* (2013.01); *A63B 23/1236* (2013.01); *A63B 2022/0079* (2013.01)

(58) Field of Classification Search

CPC ..... A63B 21/00; A63B 21/015; A63B 21/018; A63B 21/0442; A63B 21/0552; A63B 21/4043; A63B 21/22; A63B 22/20; A63B 22/205; A63B 22/201; A63B 2023/006; A63B 23/0211; A63B 23/0233; A63B 23/1236

See application file for complete search history.

(56) References Cited

U.S. PATENT DOCUMENTS 3,403,906 A * 10/1968 Burzenski ..... A63B 22/20 482/132
6,254,518 B1 * 7/2001 Yu ..... A63B 21/0004 482/132

(Continued)

FOREIGN PATENT DOCUMENTS

CN 110448859 A 11/2019

*Primary Examiner* — Megan Anderson
(74) *Attorney, Agent, or Firm* — WPAT, PC

(57) ABSTRACT

A multifunctional abdominal exercise wheel with a pulling rope includes a first wheel assembly. The first wheel assembly includes a first main support, a first main wheel, a chassis cap and a first sucking disc. An end of the first main support is detachably connected to the first main wheel. The chassis cap is connected to the first main wheel by a bearing. The first sucking disc is connected to the chassis cap by a sucking disc support, and a sucking disc spring is arranged between the sucking disc support and the chassis cap. Another end of the first main support is disposed with a first beam, and the first beam is perpendicularly connected to the first main support. The multifunctional abdominal exercise wheel may have advantages of reasonable structure, multiple functions, high utilization, easy to carry, and being capable of meeting various occasions for fitness at any time.

15 Claims, 2 Drawing Sheets

(51) Int. Cl.
*A63B 23/12* (2006.01)
*A63B 22/00* (2006.01)

(56) References Cited

U.S. PATENT DOCUMENTS

| | | | | |
|---|---|---|---|---|
| 6,585,627 | B2 * | 7/2003 | Fernandez | A63B 21/0004 482/132 |
| 9,586,088 | B2 * | 3/2017 | Wong | A63B 23/0211 |
| 9,649,521 | B2 * | 5/2017 | Miller | A61H 15/0092 |
| 10,004,942 | B1 * | 6/2018 | Huang | A63B 23/0211 |
| 2002/0123416 | A1 * | 9/2002 | Huang | A63B 21/153 482/140 |
| 2013/0217549 | A1 * | 8/2013 | Marji | A63B 22/20 482/132 |
| 2019/0336387 | A1 * | 11/2019 | Daley | A63B 23/1236 |
| 2020/0298054 | A1 * | 9/2020 | Manion | A63B 5/20 |

* cited by examiner

MULTIFUNCTIONAL ABDOMINAL EXERCISE WHEEL WITH PULLING ROPE

TECHNICAL FIELD

The invention relates to the technical field of fitness equipment, and more particularly to a multifunctional abdominal exercise wheel with a pulling rope.

DESCRIPTION OF RELATED ART

An abdominal exercise wheel (also referred to as abdominal exercise roller) is a new upgraded small pusher that can exercise muscles and joints, reduce body weight and shape the physique. Its material generally is high-quality and durable engineering plastics, the design is generous and concise, the appearance is beautiful and exquisite, sturdy and durable, the volume is medium, it is easy to carry and use. The abdominal exercise wheel is mainly used to exercise abdominal muscles and other flesh of various parts of the body such as waist hip, chest and arms, etc. Because the place required for exercise is simple, it is convenient for home use or can be carried a training place.

At present, structures of existing abdominal exercise wheels are not reasonable and their functions are single, and thus their use functions have been limited. They cannot be used in combination with a chest developer (also referred to as chest expander), nor can be used as sit-up and push-up equipment. The use functions are limited and thus cannot meet the needs of current fitness people.

A Chinese patent application No. 20810432413.5 (patent publication number of which is CN110448859A), filed on May 8, 2018, published on Nov. 15, 2109 and titled as "a multifunctional abdominal exercise wheel", discloses a multifunctional abdominal exercise wheel and belongs to the technical field of fitness equipment. The multifunctional abdominal exercise wheel includes a first wheel set and a second wheel set. The first wheel set and the second wheel set are threadedly connected with each other. The first wheel set includes wheels, a sliding buckle and a first rotary shaft; and two shaft heads A on two ends of the first rotary shaft are installed with the wheels respectively. The second wheel set includes wheels, a sliding buckle and a second rotary shaft; and two shaft heads B on two ends of the second rotary shaft are installed with the wheels respectively. Each the wheel has a second sliding slot formed in the circumferential side face, and one sliding buckle is installed in the second sliding slot. A screw head is arranged at one end of the second wheel set, and a shaft hole is formed in a middle position of each the wheel. A plurality of first engaging slots are evenly distributed in an inner side face of the shaft hole, a bearing is installed in the shaft hole, and a second engaging slot is formed in an outer side face of the bearing. Based on the threaded connection between the first wheel set and the second wheel set and movement of the sliding buckles, the application range is effectively expanded. Moreover, the multifunctional abdominal exercise wheel is simple in structure and convenient to install.

The above patent application document discloses one type of multifunctional abdominal exercise wheel. However, the function of the abdominal exercise wheel is limited, the structure is not reasonable and thus it cannot meet the needs of fitness people.

SUMMARY

A main objective of the invention is to provide a multifunctional abdominal exercise wheel with a pulling rope, which has advantages of reasonable structure, multiple functions, high utilization, easy to carry, and being capable of meeting various occasions for fitness at any time.

In order to achieve the above objective, an embodiment of the invention provides a multifunctional abdominal exercise wheel with a pulling rope, including a first wheel assembly. The first wheel assembly includes a first main support, a first main wheel, a chassis cap, and a first sucking disc. An end of the first main support is detachably connected to the first main wheel, the chassis cap is connected to the first main wheel by a bearing, the first sucking disc is connected to the chassis cap by a sucking disc support, and a sucking disc spring is arranged between the sucking disc support and the chassis cap. Another end of the first main support is disposed with a first beam, and the first beam is perpendicularly connected to the first main support.

In an embodiment, a head of the end of the first main support detachably connected to the first main wheel is formed with a screw thread, a fixing iron sheet is arranged in the first main wheel, and the first main support is connected to the first main wheel by the fixing iron sheet.

In an embodiment, a connection between the first main support and the first beam is disposed with a retractable buckle.

In an embodiment, two ends of the first beam are disposed with a first wheel and a second wheel respectively.

In an embodiment, the first main support is disposed with a first pulling rope.

In an embodiment, the multifunctional abdominal exercise wheel further includes a second wheel assembly. The second wheel assembly includes a second main support, a second main wheel, another chassis cap, and a second sucking disc. An end of the second main support is detachably connected to the second main wheel. The another chassis cap is connected to the second wheel by another bearing. The second sucking disc is connected to the another chassis cap by another sucking disc support. Another sucking disc spring is arranged between the another sucking disc support and the another chassis cap. Another end of the second main support is disposed with a second beam, and the second beam is perpendicularly connected to the second main support. The second main support and the first main support have the same size and shape, the second main wheel and the first main wheel have the same size and shape, the second sucking disc and the first sucking disc have the same size and shape, the second beam and the first beam have the same size and shape.

In an embodiment, the first wheel assembly and the second wheel assembly are mutually sucked together by the first sucking disc and the second sucking disc.

In an embodiment, a connection between the second main support and the second beam is disposed with a second retractable buckle.

In an embodiment, two ends of the second beam are disposed with a third wheel and a fourth wheel respectively.

In an embodiment, the second main support is further disposed with a second pulling rope.

The beneficial effects of the embodiments of the invention may be as follows: 1) having multiple functions, detachable structure and being convenient for installation and maintenance; 2) having a simple structure, being easy to carry, can be used for fitness in various occasions, and being safe and reliable; and 3) having the advantages of low cost, simple operation, and being suitable for general promotion.

BRIEF DESCRIPTION OF THE DRAWINGS

In order to more clearly illustrate technical solutions of embodiments of the disclosure, drawings used in the description of the embodiments will be briefly described below. Apparently, the drawings described below are merely some embodiments of the disclosure, and those skilled in the art can obtain other drawings based on these drawings without creative efforts.

DESCRIPTION OF REFERENCE NUMBERS IN DRAWINGS

Figure 1:
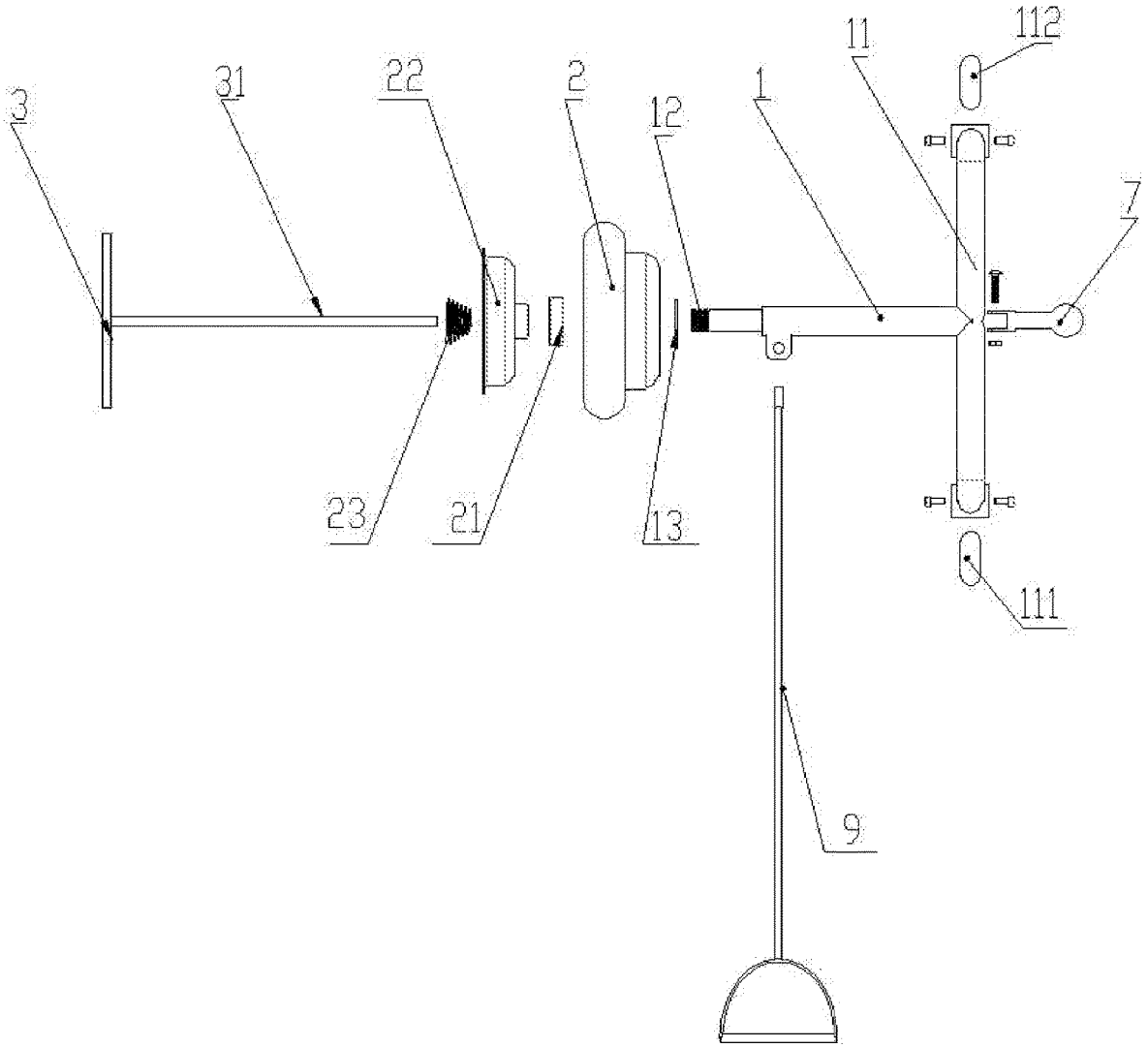
FIG. 1 is a schematic exploded view of a multifunctional abdominal exercise wheel with pulling ropes according to an embodiment of the invention.

| Reference number | description | Reference number | description |
|---|---|---|---|
| 1 | First main support | 4 | Second sucking disc |
| 11 | First beam | 5 | Second main wheel |
| 12 | Screw thread | 6 | Second main support |
| 13 | Fixing iron sheet | 61 | Second beam |
| 111 | First wheel | 611 | Third wheel |
| 112 | Second wheel | 612 | Fourth wheel |
| 2 | First main wheel | 62 | Second support hole |
| 21 | Bearing | 7 | First retractable buckle |
| 22 | Chassis cap | 8 | Second retractable buckle |
| 23 | Sucking disc spring | | |
| 3 | First sucking disc | 9 | First pulling rope |
| 31 | First sucking disc support | 10 | Second pulling rope |
| 14 | First support hole | | |

The realization of objective, functional features and advantages of the invention will be further described in combination with embodiments with reference to accompanying drawings.

DETAILED DESCRIPTION OF EMBODIMENTS

The technical solutions in the embodiments of the invention will be clearly and completely described below, with reference to the accompanying drawings in the embodiments of the invention. Apparently, the described embodiments are merely some of the embodiments of the invention, not all embodiments. Based on the described embodiments of the invention, all other embodiments obtained by those skilled in the art without any creativity should belong to the protective scope of the invention.

It is noted that, in the embodiments of the invention, all directional indications (such as "upper", "lower", "left", "right", "front", "rear", etc.) are merely for indicating relative positional relationships and motions among various components under certain specific postures (as shown in the drawings), if the specific postures change, the directional indication will change accordingly.

In the description of the invention, unless otherwise clearly stated and limited, terms "connected", "fixed" and so on should be understood broadly. For instance, "fixed" can be a fixed connection, a detachable connection or an integral connection; can be a mechanical connection, can also be an electrical connection; can be a direct connection, can also be an indirect connection by an intermediary, can be an internal communication of two elements or an interaction between two elements, unless otherwise clearly defined. A person skilled in the art can understand concrete meanings of the terms in the invention as per specific circumstances.

Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the invention. In addition, the technical solutions of various embodiments may be combined together, any combination must be based on the realization of ordinary skilled person in the art. When a combination of technical solutions is contradictory or unable to be realized, it should be considered that such the combination of technical solutions does not exist and is not within the protection scope of the invention.

The invention provides a multifunctional abdominal exercise wheel with a pulling rope.

Embodiment 1

Figure 2:
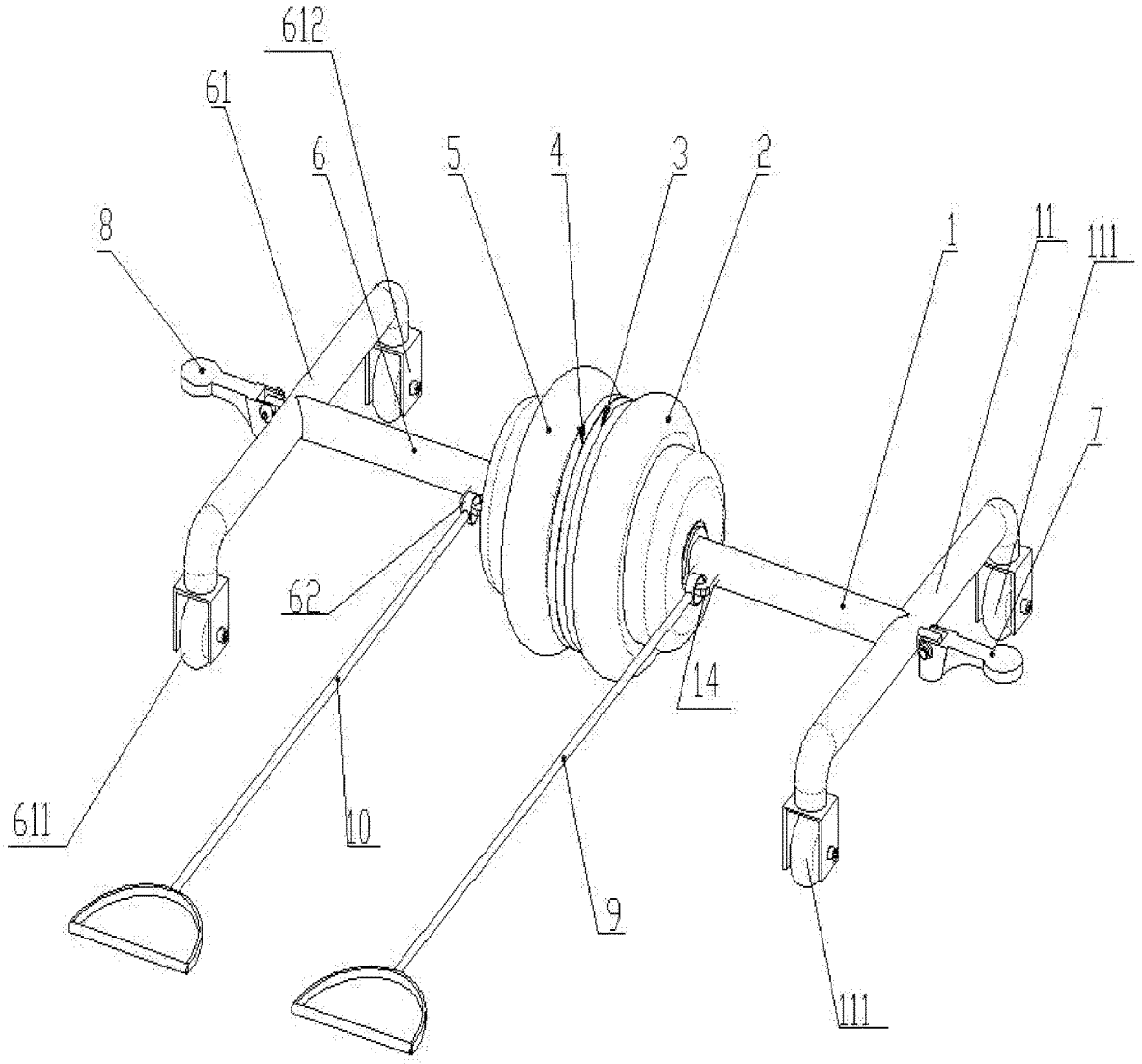
FIG. 2 is a schematic structural view of the multifunctional abdominal exercise wheel with pulling ropes according to the embodiment of the invention.

Referring to FIG. 1 and FIG. 2, in an embodiment of the invention, the multifunctional abdominal exercise wheel with a pulling rope includes a first wheel assembly. The first wheel assembly includes a first main support 1, a first main wheel 2, a chassis cap 22, and a first sucking disc 3. An end of the first main support 1 is detachably connected to the first main wheel 2. The chassis cap 22 is connected to the first main wheel 2 by a bearing 21. The first sucking disc 3 is connected to the chassis cap 22 by a sucking disc support 31. The chassis cap 22 is arranged in the first main wheel 2. The sucking disc support 31 and the chassis cap 22 have a sucking disc spring 23 arranged therebetween. The sucking disc support 31 is connected to the chassis cap 22 by the sucking disc spring 23. In other words, as exemplarily illustrated in FIG. 1 and FIG. 2, the chassis cap 22 is a cap-like rim, the first sucking disc 3 is a suction cup, the sucking disc support 31 is a supporter for supporting the suction cup, and the sucking disc spring 23 is a conical spring.

Another end of the first main support 1 is disposed with a first beam 11. The first beam 11 and the first main support 1 are perpendicularly connected with each other.

In the illustrated embodiment, preferably, a head of the end of the first main support 1 detachedly connected to the first main wheel 2 is formed with a screw thread 12, that is, the head of the end of the first main support 1 is a threaded rod end. A fixing iron sheet 13 is arranged in the first main wheel 2, and the first main support 1 is connected to the first main wheel 2 by the fixing iron sheet 13. The fixing iron sheet 12 is mainly used for securing and stabilizing the connection between the first main support 1 and the first main wheel 2. That is, the fixing iron sheet 12 shown in FIG. 1 is, for example, a sheet-like fastener made of iron.

In the illustrated embodiment, preferably, a connection between the first main support 1 and the first beam 11 is disposed with a first retractable buckle 7. The first main support 1 is connected to a middle portion of the first beam 11, and the first retractable buckle 7 is connected to the first beam 11 by a screw fastener. As seen from FIG. 1, the first retractable buckle 7 exemplarily is a lever.

In the illustrated embodiment, preferably, two ends of the first beam 11 are disposed with a first wheel 111 and a second wheel 112 respectively. The first wheel 111 and the second wheel 112 are fixedly connected to the first beam 11 individually.

In the illustrated embodiment, preferably, the first main support 1 is further disposed with a first pulling rope 9. The first main support 1 is formed with a first support hole 14, and the first pulling rope 9 is connected to the first main support 1 by the first support hole 14.

Embodiment 2

Referring to FIG. 1 and FIG. 2 again, different from the above-mentioned embodiment, the multifunctional abdominal exercise wheel in this embodiment further includes a second wheel assembly. The second wheel assembly includes a second main support 6, a second main wheel 5, another chassis cap, and a second sucking disc 4. One end of the second main support 6 is detachably connected to the second main wheel 5. The another chassis cap is connected to the second main wheel 5 by another bearing. The second sucking disc 4 is connected to the another chassis cap by another sucking disc support. The another sucking disc support and the another chassis cap have another sucking disc spring arranged therebetween. The other end of the second main support 6 is disposed with a second beam 61, and the second beam 61 is perpendicularly connected to the second main support 6. In other words, as exemplarily illustrated in FIG. 1 and FIG. 2, the another chassis cap is a cap-like rim, the second sucking disc 4 is a suction cup, the another sucking disc support is a supporter for supporting the suction cup, and the another sucking disc spring is a conical spring.

The second main support 6 and the first main support 1 have the same size and shape. The second main wheel 5 and the first main wheel 2 have the same size and shape. The second sucking disc 4 and the first sucking disc 3 have the same size and shape. The second beam 61 and the first beam 11 have the same size and shape.

In the illustrated embodiment, the first wheel assembly and the second wheel assembly are mutually sucked together by the first sucking disc 3 and the second sucking disc 4.

In the illustrated embodiment, the structures, sizes and shapes of the second wheel assembly and the first wheel assembly are exactly the same. The chassis cap, the bearing, the sucking disc support and the sucking disc spring of the second wheel assembly is not shown in the drawings.

Actually, the abdominal exercise wheel in this embodiment is composed of two wheel assemblies, and concretely is formed by two completely same wheel assemblies sucked together by the sucking discs.

In the illustrated embodiment, preferably, a connection of the second main support 6 with the second beam 61 is disposed with a second retractable buckle 8. The second main support 6 is connected to a middle portion of the second beam 61, and the second retractable buckle 8 is connected to the second beam 61 by a screw fastener.

In the illustrated embodiment, preferably, two ends of the second beam 61 are disposed with a third wheel 611 and a fourth wheel 612 respectively. The third wheel 611 and the fourth wheel 612 are fixedly connected to the second beam 61 individually.

In the illustrated embodiment, preferably, the second main support 6 is further disposed with a second pulling rope 10. The second main support 6 is formed with a second support hole 62, and the second pulling rope 10 is connected to the second main support 6 by the second support hole 62.

The invention is mainly used to exercise muscles in different parts of the body such as abdomen, waist hip, chest, arms, etc. Because the place required for exercise is simple, it is convenient for home use or can be carried to a training place.

Routine exercising modes based on the invention may include: (1) standard kneeling exercising mode: placing knees on a special kneeling pad, gripping a handle of the abdominal exercise wheel firmly with both hands, and repeatedly carrying out operations of pushing the abdominal exercise wheel forward until the body is level with the ground and then recovering; (2) standard standing exercising mode: standing on a level ground with feet together, gripping the handle of the abdominal exercise wheel firmly with both hands, pressing the wheels onto a wall, and repeatedly carrying out operations of pushing the abdominal exercise wheel upwards and then recovering; (3) shins exercising mode: sitting on a chair, putting feet on the handle of the abdominal exercise wheel, and repeatedly carrying out operations of pushing the abdominal exercise wheel with the feet forward and then recovering; (4) Yoga type exercising mode: sitting on the ground, opening two legs into a V shape, grasping the handle of the abdominal exercise wheel and repeatedly carrying out operations of extending your body forward or leftwards/rightwards to a maximum degree/extent and then recovering; (5) backward exercising mode: sitting on the ground, putting the abdominal exercise wheel behind, grasping the handle of the abdominal exercise wheel with both hands and repeatedly carrying out operations of pushing the abdominal exercise wheel to extend the body backwards to a maximum extent and then recovering; and (6) light-intensity exercising mode: facing a wall, raising the abdominal exercise wheel and repeatedly carrying out operations of pushing the abdominal exercise wheel towards the wall and extending upwards and then recovering.

An assisting sit-ups exercising mode based on the invention is that: placing the sucking disc of unilateral abdominal exercise wheel on the floor plane, pressing a sucking disc switch button to make the whole sucking disc suck the floor stably, hooking opposite handles of the abdominal exercise wheel with the backs of feet, facing up, and laying your body flat and then repeatedly doing the sit-up exercise by use of the abdominal exercise wheel.

An assisting push-ups exercising mode based on the invention is that: placing the sucking disc of unilateral abdominal exercise wheel on the floor plane, pressing a sucking disc switch button to make the whole sucking disc suck the floor stably, putting legs straightly on a yoga mat, grasping handles on opposite side of the sucking disc of the abdominal exercise wheel with both hands, facing down and then repeatedly doing the push-up exercise by use of the abdominal exercise wheel.

A pulling rope exercising mode based on the invention is that: combing the first wheel assembly and the second wheel assembly into a whole abdominal exercise wheel by mutual sucking of the two sucking discs, fastening pulling ropes onto both sides by the first support hole 14 and the second support hole 62, sitting on a seat cushion, stepping on the handle of the abdominal exercise wheel with both feet, gripping handles of the pulling ropes with both hands, and repeatedly carrying out operations of pulling the ropes toward the back of body and then recovering, which can exercise pectoral muscles, arms and leg muscle strengths, and shape the physique.

The invention has made a brand-new design and change of the abdominal exercise wheel, adopts detachable devices, and uses auxiliary equipment such as pulling ropes and sucking discs. It is convenient to use and acts as a multi-functional fitness equipment having the ability to exercise and shape the abdomen, waist and hips, arms, legs and chest muscles, reduce body weight, and assist push-ups and sit-ups.

The invention has multiple functions and is convenient to use. The overall structure is simple and reliable, small in size, and easy to carry.

The above are only preferred embodiments of the invention, and does not limit the patent protection scope of the invention. On the premise of not departing from the spirit and scope of the invention, the invention will have various modification and improvements. Under the inventive concept of the invention, equivalent structural transformations made by using the description and the attached drawings of the invention, or direct/indirect application in other related technical fields are all included in the scope of patent protection of the invention.

What is claimed is:

1. A multifunctional abdominal exercise wheel, comprising a first wheel assembly;

wherein the first wheel assembly comprises a first main support, a first main wheel, a cap and a first suction cup; an end of the first main support is detachably connected to the first main wheel, the cap is connected to the first main wheel by a bearing, the first suction cup is connected to the cap by a supporter, and a spring is arranged between the supporter and the cap;

wherein another end of the first main support is disposed with a first beam, and the first beam is perpendicularly connected to the first main support.

2. The multifunctional abdominal exercise wheel as claimed in claim 1, further comprising a second wheel assembly; wherein the second wheel assembly comprises a second main support, a second main wheel, a second cap, and a second suction cup; an end of the second main support is detachably connected to the second main wheel, the second cap is connected to the second main wheel by a bearing, the second suction cup is connected to the second cap by a second supporter, another spring is arranged between the second supporter and the second cap; another end of the second main support is disposed with a second beam, and the second beam is perpendicularly connected to the second main support;

wherein the second main support and the first main support have the same size and shape, the second main wheel and the first main wheel have the same size and shape, the second suction cup and the first suction cup have the same size and shape, the second beam and the first beam have the same size and shape.

3. The multifunctional abdominal exercise wheel as claimed in claim 2, wherein the first wheel assembly and the second wheel assembly are mutually sucked together by the first suction cup and the second suction cup.

4. The multifunctional abdominal exercise wheel as claimed in claim 3, wherein a connection between the second main support and the second beam is disposed with a second lever.

5. The multifunctional abdominal exercise wheel as claimed in claim 4, wherein two ends of the second beam are disposed with a third wheel and a fourth wheel respectively.

6. The multifunctional abdominal exercise wheel as claimed in claim 5, wherein the second main support is further disposed with a second pulling rope.

7. The multifunctional abdominal exercise wheel as claimed in claim 1, wherein a connection between the first main support and the first beam is disposed with a first lever.

8. The multifunctional abdominal exercise wheel as claimed in claim 7, wherein two ends of the first beam are disposed with a first wheel and a second wheel respectively.

9. The multifunctional abdominal exercise wheel as claimed in claim 8, wherein the first main support is further disposed with a first pulling rope.

10. The multifunctional abdominal exercise wheel as claimed in claim 1, wherein a head of the end of the first main support detachably connected to the first main wheel is formed with a screw thread, a fastener is disposed in the first main wheel, and the first main support is connected to the first main wheel by the fastener.

11. The multifunctional abdominal exercise wheel as claimed in claim 10, wherein a connection between the first main support and the first beam is disposed with a first lever.

12. A multifunctional abdominal exercise wheel with pulling ropes, comprising:

a first wheel assembly, wherein the first wheel assembly comprises:

a first main support, a first main wheel, a cap and a first suction cup; an end of the first main support is detachably connected to the first main wheel, the cap is connected to the first main wheel by a bearing, the first suction cup is connected to the cap by a supporter, and a spring is arranged between the supporter and the cap; another end of the first main support is disposed with a first beam, and the first beam is connected to the first main support; two ends of the first beam are disposed with a first wheel and a second wheel respectively, and the first main support is further disposed with a first one of the pulling ropes; and a second wheel assembly, wherein the second wheel assembly comprises:

a second main support, a second main wheel, a second cap and a second suction cup; an end of the second main support is detachably connected to the second main wheel, the second cap is connected to the second main wheel by a bearing, the second suction cup is connected to the second cap by a second supporter, another spring is arranged between the second supporter and the second cap; another end of the second main support is disposed with a second beam, and the second beam is connected to the second main support; two ends of the second beam are disposed with a third wheel and a fourth wheel respectively, and the second main support is further disposed with a second one of the pulling ropes.

13. The multifunctional abdominal exercise wheel as claimed in claim 12, wherein the first wheel assembly and the second wheel assembly are capable of being mutually sucked together by the first suction cup and the second suction cup.

14. The multifunctional abdominal exercise wheel as claimed in claim 13, wherein a connection between the first main support and the first beam is disposed with a first lever, and the first lever is connected to the first beam by a screw fastener; a connection between the second main support and the second beam is disposed with a second lever, and the second lever is connected to the second beam by another screw fastener.

15. The multifunctional abdominal exercise wheel as claimed in claim 13, wherein the first main support is formed with a first support hole, and the first one of the pulling ropes is connected to the first main support by the first support hole; the second main support is formed with a second support hole, and the second one of the pulling ropes is connected to the second main support by the second support hole.

* * * * *